US007905485B2

(12) United States Patent
Wang et al.

(10) Patent No.: US 7,905,485 B2
(45) Date of Patent: Mar. 15, 2011

(54) PAPER FEEDING APPARATUS AND PAPER FEEDING METHOD THEREOF WITH A PLURALITY OF FORCE UNITS WITH FLUID-SUPPLY DEVICES

(75) Inventors: Chih-Hwa Wang, Shenkeng Township, Taipei County (TW); Chih-Hsing Chen, Shenkeng Township, Taipei County (TW)

(73) Assignee: Kinpo Electronics, Inc., Taipei County (TW)

( * ) Notice: Subject to any disclaimer, the term of this patent is extended or adjusted under 35 U.S.C. 154(b) by 336 days.

(21) Appl. No.: 12/213,706

(22) Filed: Jun. 24, 2008

(65) Prior Publication Data

US 2009/0315252 A1 Dec. 24, 2009

(51) Int. Cl.
*B65H 5/06* (2006.01)

(52) U.S. Cl. ..... 271/272

(58) Field of Classification Search ..... None
See application file for complete search history.

(56) References Cited

U.S. PATENT DOCUMENTS

| | | | | |
|---|---|---|---|---|
| 2,627,969 | A * | 2/1953 | Darner et al. | 271/274 |
| 4,533,135 | A * | 8/1985 | Barker | 271/273 |
| 2002/0130463 | A1* | 9/2002 | Michel | 271/274 |
| 2003/0193126 | A1* | 10/2003 | Hoberock | 271/272 |

* cited by examiner

*Primary Examiner* — Stefanos Karmis
*Assistant Examiner* — Gerald W McClain
(74) *Attorney, Agent, or Firm* — Rosenberg, Klein & Lee

(57) ABSTRACT

A paper feeding apparatus includes a fluid-supply device, a connecting pipe communicating with the fluid-supply device, and a plurality of force units connecting to the connecting pipe, each force unit having a pressing wheel on one end thereof, wherein each pressing wheel operates in coordination with a paper feeding wheel for feeding paper. The force units output equal force according to the same hydraulic pressure so that the pressing wheels provide the same component force to the corresponding paper feeding wheel so as to improve the quality of paper feeding. Furthermore, a method for using the paper feeding apparatus is disclosed.

14 Claims, 4 Drawing Sheets

PAPER FEEDING APPARATUS AND PAPER FEEDING METHOD THEREOF WITH A PLURALITY OF FORCE UNITS WITH FLUID-SUPPLY DEVICES

BACKGROUND OF THE INVENTION

1. Field of the Invention

The present invention relates to a paper feeding apparatus and a paper feeding method using the same, and in particular to a paper feeding apparatus with a cylinder device for outputting equal feeding force.

2. Description of Prior Art

Computers are widely used in the modern life and printers are popular outputting machines for outputting data stored in a computer. Consumers choose a printer depending on the printing quality. Furthermore, the considerations such as printing rate, printing stability and printing reliability are also important criteria when end-users buy a printer. High printing stability relies on a well-controlled feeding mechanism. The feeding mechanism has many functions, such as drawing paper from different trays and driving the single piece of paper to move by a wheel. The paper is fed into the printer and the selected data is printed on the paper.

However, the wheels are connected on the axle in the traditional feeding mechanism. Due to the errors of manufacturing or assembling, the wheels may output force with different quantities. The paper is driven by different forces so that the parts of paper can not move in the same speed and then paper jams occur. A flexible axle has been developed for solving the problem. The flexible axle is simply made of elastic material, but the correcting range is too small to compensate efficiently for the different forces.

Therefore, in view of this, the inventor proposes the present invention to overcome the above problems based on his expert experience and deliberate research.

SUMMARY OF THE INVENTION

The primary object of the present invention is provided for a paper feeding apparatus and a paper feeding method using the same. According to Pascal's principle of hydraulic pressure, each force unit of the paper feeding apparatus can output the same component on a corresponding paper feeding wheel so that paper is driven to feed in a machine by the same feeding friction.

In order to achieve the above object, the present invention provides a paper feeding apparatus comprising: a fluid-supply device; a connecting pipe communicating with the fluid-supply device; and a plurality of force units connecting to the connecting pipe, each force unit having a pressing wheel on one end thereof; wherein each pressing wheel operates in coordination with a paper feeding wheel for feeding paper.

In order to achieve the above object, the present invention further provides a paper feeding apparatus comprising: a fluid-supply device; a connecting pipe communicating with the fluid-supply device, wherein the connecting pipe has a first auxiliary pipe and a second auxiliary pipe; a pressing module connecting to the first auxiliary pipe, wherein the pressing module has a plurality of first force units; and a second force unit connecting to the second auxiliary pipe, wherein the first force units and the second force unit individually has a pressing wheel; wherein each pressing wheel operates in coordination with a paper feeding wheel for feeding paper.

In order to achieve the above object, the present invention still further provides a paper feeding method comprising:

providing a paper feeding unit having a plurality of paper feeding wheels, and assembling a paper feeding apparatus on the paper feeding unit, the paper feeding apparatus comprising: a fluid-supply device; a connecting pipe communicating with the fluid-supply device; and a plurality of force units connecting to the connecting pipe, each force unit having a pressing wheel on one end thereof wherein the fluid-supply device supply a fluid to the force units thought the connecting pipe; wherein each pressing wheel operates in coordination with the corresponding paper feeding wheel for feeding paper; wherein the force units output equal force so that the pressing wheels apply the same force to the corresponding paper feeding wheels in order to form equal friction force for feeding paper.

In the present invention, Pascal's principle of hydraulic pressure and the equal cross-section areas are used for construct the paper feeding apparatus so that each of pressing wheels outputs the same components on corresponding paper feeding wheel. Therefore, the problems of "paper jam" for the reasons of imprecision of the assembly are solved.

In order to better understand the characteristics and technical contents of the present invention, a detailed description thereof will be made with reference to the accompanying drawings. However, it should be understood that the drawings and the description are illustrative but not used to limit the scope of the present invention.

DETAILED DESCRIPTION OF THE INVENTION

Figure 1:
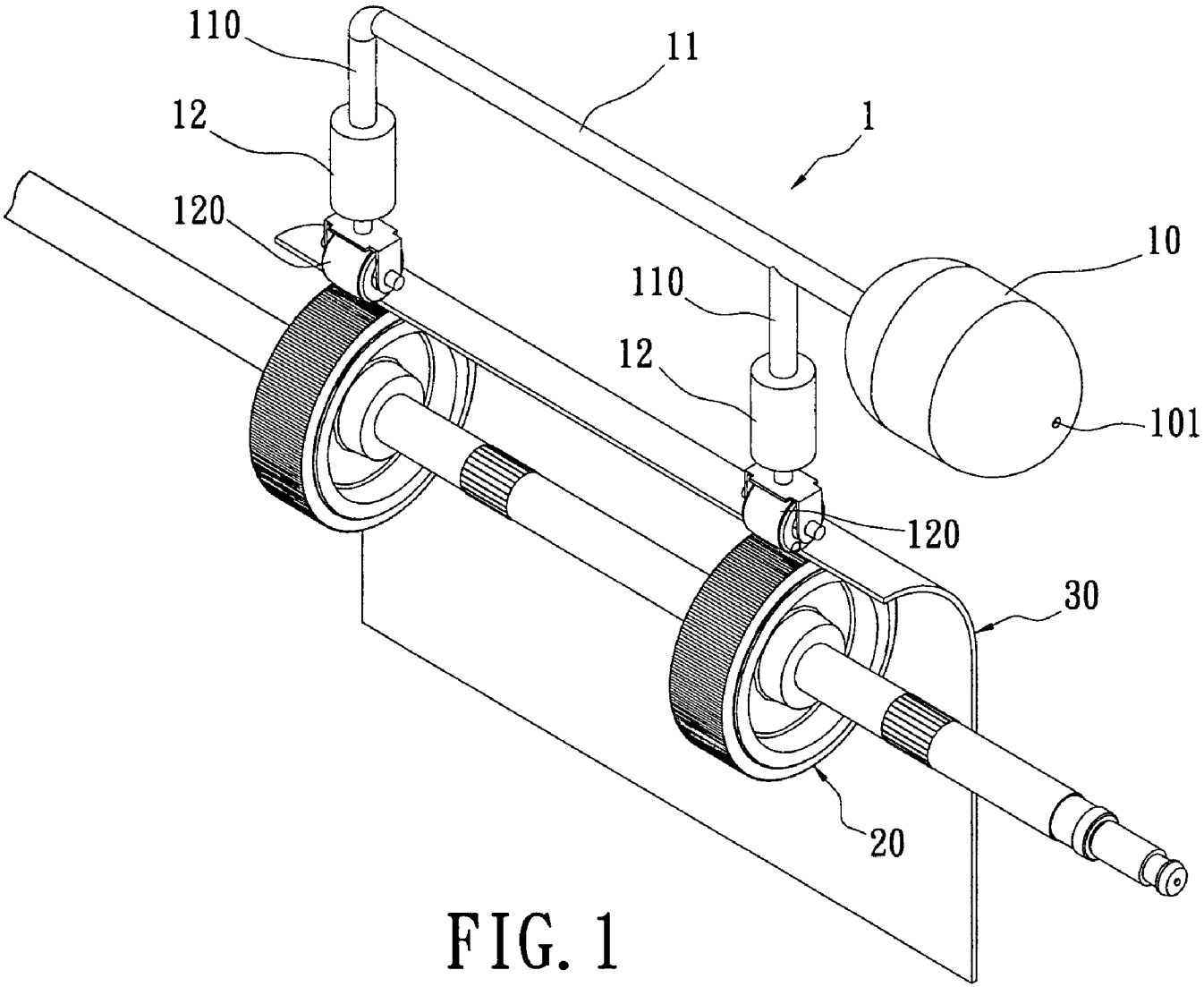
FIG. 1 is a schematic view showing the paper feeding apparatus according to the present invention.
Figure 2:
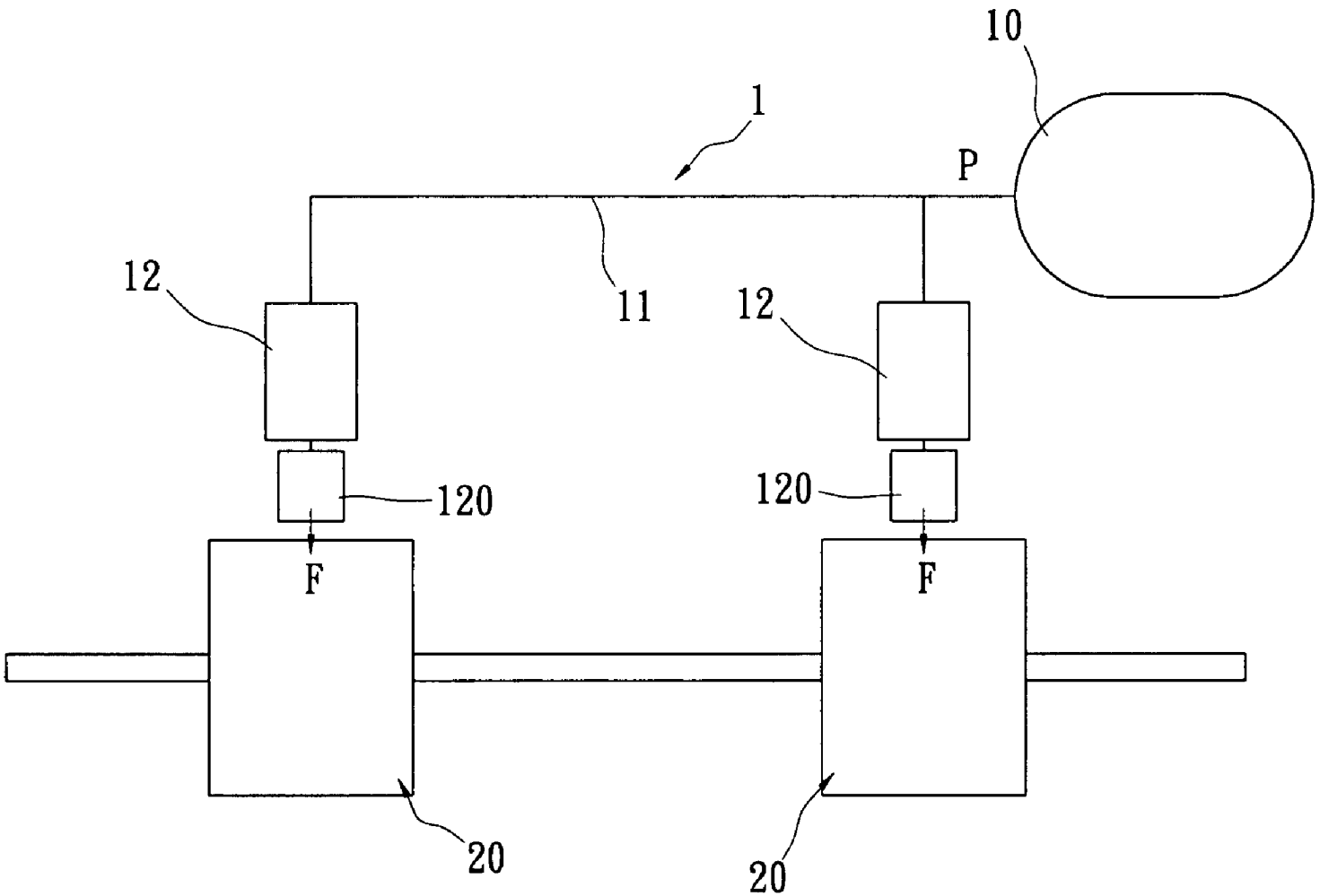
FIG. 2 is a simplified view showing the paper feeding apparatus in usage according to the present invention.

Please refer to FIGS. 1 and 2, the invention discloses a paper feeding apparatus 1 and a paper feeding method using the same. The paper feeding apparatus 1 is used for achieving a better paper-feeding quality. The paper feeding apparatus 1 has a fluid-supply device 10; a connecting pipe 11 communicating with the fluid-supply device 10; and a plurality of force units 12 connecting to the connecting pipe 11. Furthermore each force unit 12 has a pressing wheel 120 on one end thereof. The fluid-supply device 10 provides a fluid to the connecting pipe 11 and force units 12. The fluid-supply device 10, for example, can be a container to preserve the fluid and supply it to the connecting pipe 11. The paper feeding apparatus 1 is assembled on a printer or other device with a paper feeding mechanism. Depending on the fluid, a fluid pressure is generated in the connecting pipe 11 and force units 12.

The fluid-supply device 10 provides a fluid which can be a liquid or a gas and the fluid contained in the connecting pipe 11 outputs a hydraulic pressure P to drive the force units 12 to generate a force. In other words, the force units 12 can output force F by transforming the hydraulic pressure of the fluid. The fluid-supply device 10 further has an inlet valve 101 which is applied for filling or compensating the fluid in the fluid-supply device 10.

Furthermore, the connecting pipe 11 is an empty tube within which the fluid flows and forms the fluid pressure P. The connecting pipe 11 has a plurality of auxiliary pipes 110 and the force units 12 connect to the auxiliary pipes 110. The hydraulic pressure P is generated as the fluid flows inside the connecting pipe 11 and auxiliary pipes 110.

Figure 4:
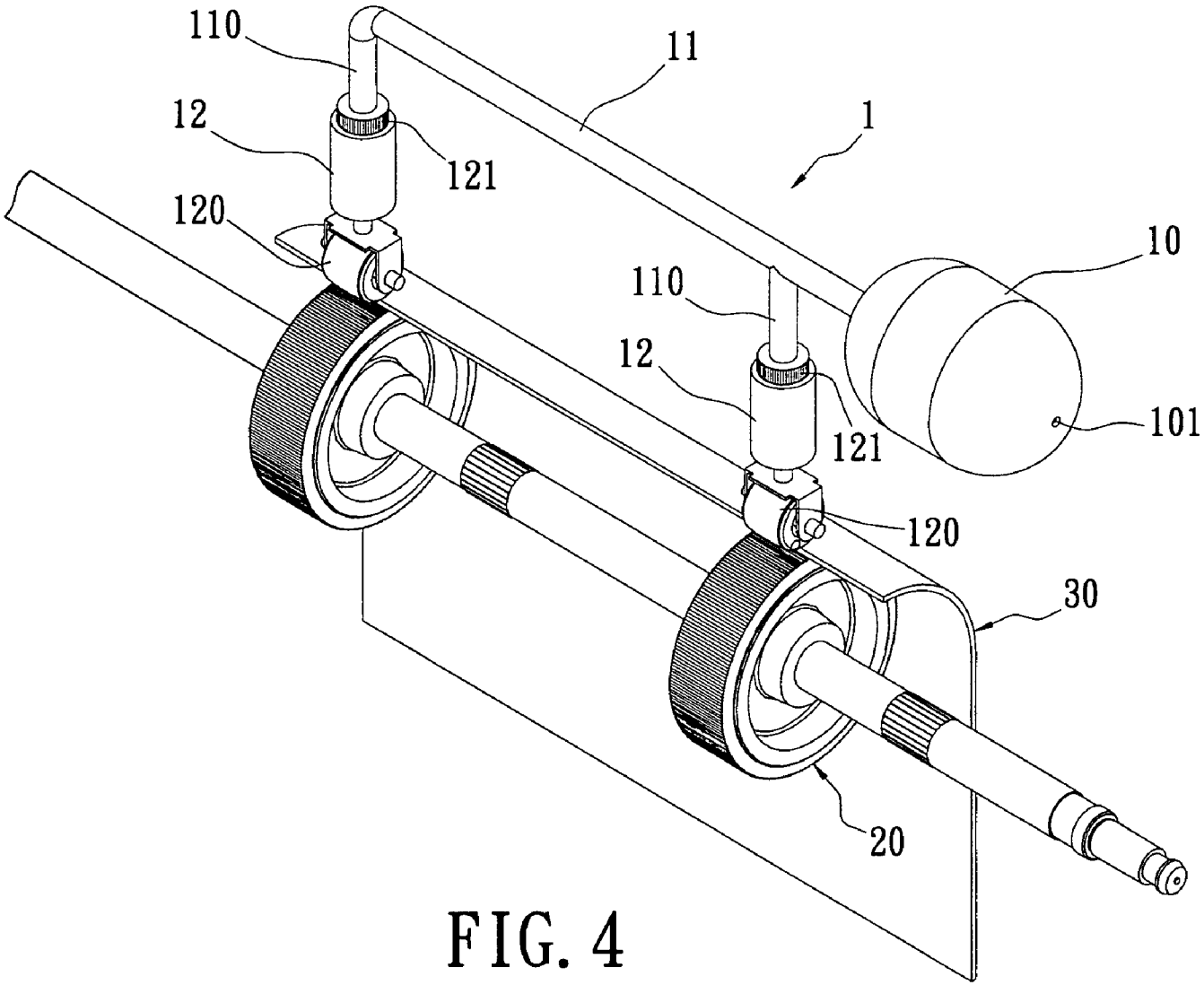
FIG. 4 is schematic representation showing the third embodiment of the paper feeding apparatus according to the present invention.

The force units 12 are used for transforming the hydraulic pressure P into a force. In the embodiment, the force units are cylinders with equal cross-section areas so that the forces generated by the force units 12 can be equal. Concerning Pascal's principle, pressure applied to an enclosed fluid is transmitted undiminished to every part of the fluid, as well as to the walls of the container. Therefore, equal fluid pressure is generated on the force units 12 because of the fluid in the enclosed system including the fluid-supply device 10, connecting pipe 11 and auxiliary pipes 110. On the condition that the force units 12 have equal cross-section areas, the force units 12 can output equal force F on the corresponding pressing wheel 120. However, the force unit 12 further has a controlling valve 121 to output equal force F on the corresponding pressing wheel 120 even if the force units 12 does not have equal cross-section areas due to the imprecision of manufacturing or the other reasons shown in FIG. 4.

The pressing wheel 120 of the force units 12 is rotatably pivoted on the force units 12. The pressing wheels 120 apply a force to the paper feeding wheel 20 and operate in coordination with the paper feeding wheel 20 so as to feed paper. The corresponding pressing wheel 120 and the paper feeding wheel 20 rotate in opposite directions, moving the paper by means of friction.

Please refer to FIGS. 1 and 2, the application of paper feeding apparatus 1. The paper feeding apparatus 1 is assembled on a printer or the like and the pressing wheels 120 of the paper feeding apparatus 1 are corresponding to the paper feeding wheels 20. The fluid generates the hydraulic pressure P in each of the force units 12 because of the enclosed tube system (i.e. connecting pipe 11 and auxiliary pipes 110). Therefore, the pressing wheels 120 apply a force to the paper feeding wheels 20 with equal value of force because the force units 20 output equal force. In other words, there is equal degree of friction between the corresponding pressing wheels 120 and the paper feeding wheels 20 so that the paper can be fed in smoothly.

Accordingly, user can send paper 30 between the corresponding pressing wheels 120 and the paper feeding wheels 20 and paper 30 is fed into the printer smoothly with the same velocity. The method for using the paper feeding apparatus 1 is assembling the paper feeding apparatus 1 on a paper feeding unit, for example, a printer. The fluid in the paper feeding apparatus 1 performs the equal hydraulic pressure P everywhere depending on Pascal's principle. In case of the force units 12 has equal cross-section area or controlled by the controlling valve 122, the force units 12 can output equal degree of force. At last, there is equal degree of friction between the corresponding pressing wheels 120 and the paper feeding wheels 20 so that the paper can be fed. Accordingly, the problem of paper jam in the traditional printer is solved because of the equal paper feeding force. Furthermore, depending on different kinds of paper 30, the fluid-supply device 10 can provide the fluid in corresponding hydraulic pressure P. Therefore, the force units 12 can output different force so that the paper can be fed more uniformly.

Figure 3:
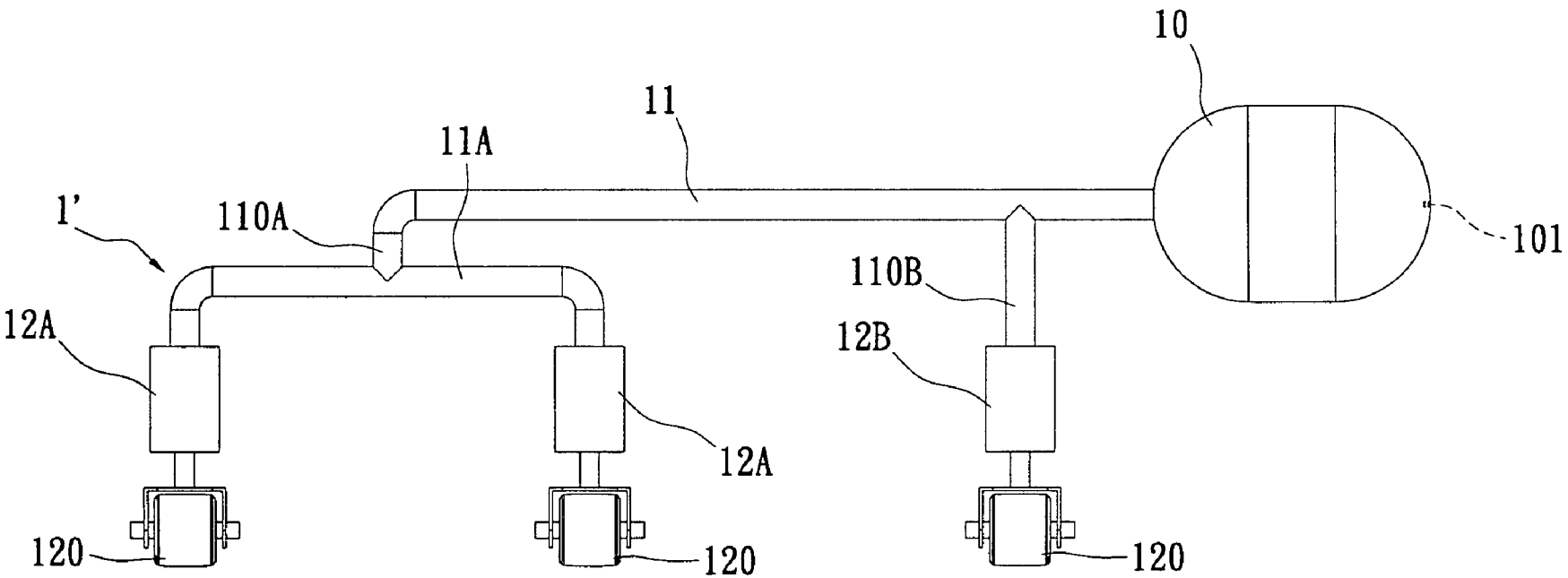
FIG. 3 is a simplified view showing the second embodiment of the paper feeding apparatus according to the present invention.

Please refer to FIG. 3, the second embodiment is shown. In the second embodiment, there are different numbers of force units 12 disposed on the opposite end of connecting pipe 11. Two first force units 12A disposed on the right end of the connecting pipe 11 are constructed as a pressing module 1'. The pressing module 1' further has connecting tube 11A connected to the two first force units 12A. Similarly, the paper feeding apparatus 1 has a fluid-supply device 10 and a connecting pipe 11 communicating with the fluid-supply device 10. The fluid-supply device 10 further has an inlet valve 101 which is applied for filling or compensating the fluid in the fluid-supply device 10. The connecting pipe 11 has a first auxiliary pipe 110A and a second auxiliary pipe 110B. The connecting tube 11A of the pressing module 1' connects with the first auxiliary pipe 110A and the second auxiliary pipe 110B connects to a second force unit 12B. When the fluid is supplied by the fluid-supply device 10, the fluid generates equal hydraulic pressure P in the connecting pipe 11, the first auxiliary pipe 110A, the second auxiliary pipe 110B and the connecting tube 11A. Therefore, each first and second force units 12A, 12B can output equal degree of force so that there is equal degree of friction between the corresponding pressing wheels and paper feeding wheels. However, the number of the force unit is taken for example, but not to restrict to the present invention. Moreover, the first and second force units 12A, 12B have the same features with the first embodiment, for example the controlling valve 121.

To sum up, the present invention has the following advantages:

1. By transmitting the equal hydraulic pressure to the equal degree of force, the paper feeding apparatus operates with Pascal's principle so that the friction is equal between the corresponding pressing wheel and paper feeding wheel.
2. There can be different numbers of pressing units on the two sides of the connecting pipe to construct as a pressing module so that the paper feeding apparatus can be applied for more different applications.

Although the present invention has been described with reference to the foregoing preferred embodiment, it will be understood that the invention is not limited to the details thereof. Various equivalent variations and modifications may occur to those skilled in this art in view of the teachings of the present invention. Thus, all such variations and equivalent modifications are also embraced within the scope of the invention as defined in the appended claims.

What is claimed is:

1. A paper feeding apparatus, comprising:

a fluid-supply device;

a connecting pipe having an inlet end and a plurality of outlet ends, and the connecting pipe communicating with the fluid-supply device on the inlet end; and a plurality of force units, respectively connecting to the outlet ends of the connecting pipe, each force unit having a fluid cylinder that is disposed directly above a pressing wheel for directly transmitting force to the pressing wheel on one end thereof;

wherein each pressing wheel operates in coordination with a paper feeding wheel for feeding paper.

2. The paper feeding apparatus according to claim 1, wherein the fluid-supply device has fluid thereinside.

3. The paper feeding apparatus according to claim 2, wherein the force units have equal cross-section areas.

4. The paper feeding apparatus according to claim 2, wherein the connecting pipe has a plurality of auxiliary pipes and each auxiliary pipe connects to the corresponding force unit.

5. The paper feeding apparatus according to claim 4, wherein the fluid flows into the force units though the connecting pipe and the auxiliary pipes.

6. The paper feeding apparatus according to claim 1, wherein each force unit further has a controlling valve.

7. The paper feeding apparatus according to claim 1, wherein the pressing wheel is rotatably connected to the force unit.

8. The paper feeding apparatus according to claim 1, wherein the fluid-supply device further has an inlet valve.

9. A paper feeding method, comprising:

providing a paper feeding unit having a plurality of paper feeding wheels, and assembling a paper feeding apparatus on the paper feeding unit, the paper feeding apparatus comprising:

a fluid-supply device;

a connecting pipe having an inlet end and a plurality of outlet ends, and the connecting pipe communicating with the fluid-supply device on the inlet end; and a plurality of force units, respectively connecting to the outlet ends of the connecting pipe, each force unit having a fluid cylinder that is disposed directly above a pressing wheel for directly transmitting force to the pressing wheel on one end thereof wherein the fluid-supply device supplies a fluid to the force units thought the connecting pipe;

wherein each pressing wheel operates in coordination with the corresponding paper feeding wheel for feeding paper;

wherein the force units output equal force so that the pressing wheels apply the same force to the corresponding paper feeding wheels in order to form equal friction for feeding paper.

10. The paper feeding method according to claim 9, wherein the fluid supplied by the fluid-supply device generates equal fluidic pressures on the force units.

11. The paper feeding method according to claim 10, further comprising providing paper between the pressing wheels and the paper feeding wheels.

12. The paper feeding method according to claim 11, wherein the force units output a predetermined force depending on the kind of paper used.

13. The paper feeding method according to claim 9, wherein the force units further have a controlling valve individually, the fluid is controlled by the controlling valve for generating equal force at the force units.

14. The paper feeding method according to claim 9, wherein the fluid-supply device further has an inlet valve, the fluid is injected into the fluid-supply device though the inlet valve and the fluid flows inside the connecting pipe.

* * * * *